US005809883A

United States Patent [19]

Rodi

[11] Patent Number: 5,809,883

[45] Date of Patent: Sep. 22, 1998

[54] DRIVE FOR A PLURALITY OF TRANSFER CYLINDERS OF A PRINTING MACHINE

[76] Inventor: Anton Rodi, Karlsruher Strasse 12, D-69181 Leimen, Germany

[21] Appl. No.: 759,388

[22] Filed: Dec. 4, 1996

[30] Foreign Application Priority Data

Dec. 4, 1995 [DE] Germany ..... 195 45 114.7

[51] Int. Cl.[6] ..... B41F 13/21

[52] U.S. Cl. ..... 101/216

[58] Field of Search ..... 101/216

[56] References Cited

U.S. PATENT DOCUMENTS

| | | | |
|---|---|---|---|
| 1,171,490 | 2/1916 | Wood | 101/216 |
| 1,338,347 | 4/1920 | Wood | 101/216 |
| 2,362,069 | 11/1944 | Huck | 101/216 |
| 3,138,097 | 6/1964 | Harris et al. | 101/216 |
| 3,196,788 | 7/1965 | Knowles | 101/216 |

FOREIGN PATENT DOCUMENTS

| | | | |
|---|---|---|---|
| 21 59 03 | 12/1908 | Germany . | |
| 154 26 02 | 3/1971 | Germany . | |
| 2802153 | 7/1979 | Germany | 101/216 |
| 207 359 | 4/1982 | Germany . | |
| 54800 | 2/1990 | Germany . | |
| 44 01 300 A1 | 8/1994 | Germany . | |

*Primary Examiner*—Edgar S. Burr
*Assistant Examiner*—Amanda B. Sandusky
*Attorney, Agent, or Firm*—Herbert L. Lerner; Laurence A. Greenberg

[57] ABSTRACT

A device for driving a plurality of transfer cylinders of a digital printing machine includes a motor to which one of the plurality of transfer cylinders is connected, and bearer rings rollable on one another under a preloading, the plurality of transfer cylinders being connected to one another via the bearer rings.

6 Claims, 1 Drawing Sheet

DRIVE FOR A PLURALITY OF TRANSFER CYLINDERS OF A PRINTING MACHINE

BACKGROUND OF THE INVENTION

Field of the Invention

The invention relates to a drive for a plurality of transfer cylinders of a printing machine, more particularly, a digital printing machine.

With conventional offset printing machines or presses, the transfer cylinders thereof, such plate and blanket cylinders are connected to one another via gearwheels in order to be driven in synchronism. An absolute forced synchronization of the transfer cylinders by gearwheels is necessary to precisely maintain the relative phase position thereof even after an arbitrary number of rotations.

In addition, bearer or Schmitz rings are provided at both ends of the plate cylinder and the blanket cylinder, the bearer rings being formed of hardened and polished steel and having a respective outer diameter generally like the diameter of the pitch circle of the gearwheel of the respective cylinder. Together with the cylinders, the bearer rings roll off against one another or roll on one another under a preloading, which effects a quiet running of the printing machine, protects the drive, and extends the service life of the printing plate.

SUMMARY OF THE INVENTION

It is accordingly an object of the invention to provide a drive for a plurality of transfer cylinders of a printing machine, particularly a digital printing machine, which has a relatively simple construction.

With the foregoing and other objects in view, there is provided, in accordance with the invention, a device for driving a plurality of transfer cylinders of a digital printing machine, comprising a motor to which one of the plurality of transfer cylinders is connected, and bearer rings rollable on one another under a preloading, the plurality of transfer cylinders being connected to one another via the bearer rings.

In accordance with another feature of the invention, one of the bearer rings is axially fastened to each axial end of each transfer cylinder of the plurality of transfer cylinders, at least, respectively, two of the plurality of transfer cylinders and the bearer rings corresponding thereto being rollable on one another, the preloading ($F_s$) between the bearer rings of two transfer cylinders rolling on one another is considerably greater than a contact force ($F_z$) existing between the two transfer cylinders, the preloading being multiplied by a ratio of a static friction coefficient ($\mu_z$) of the contacting surfaces of the two transfer cylinders to a static friction coefficient ($\mu_z$) of the contacting surfaces of the bearer rings.

In accordance with a further feature of the invention, a ratio of the diameters of the bearer rings of the two transfer cylinders rollable on one another approximates a ratio of the transfer cylinder circumferences effective during operation.

In accordance with an added feature of the invention, one of the two transfer cylinders rolling on one another has a jacket formed of elastic material for transferring printing ink onto a substrate.

In accordance with an additional feature of the invention, the motor is connected to the transfer cylinder having the jacket formed of elastic material.

In accordance with a concomitant feature of the invention, respective transfer cylinders of a plurality of printing units of the printing machine are connected to one another via the bearer rings, the motor being connected to one of the transfer cylinders of the plurality of printing units.

A digital printing machine operates, for example, as follows: a printing image is applied onto a first transfer cylinder which, for printing technology reasons, has a hardened surface, face, from the first transfer cylinder, the printing image is then transferred onto a second transfer cylinder having an outer jacket or cylindrical surface formed of elastic material, from the second transfer cylinder, the printing image is transferred onto a substrate, the elastic material being able to adhere closely to a substrate, such as paper, for example, for the purpose of effecting a uniform ink transfer. The first transfer cylinder corresponds to the plate cylinder of an offset printing press, and the second transfer cylinder corresponds to the blanket cylinder of an offset printing press.

According to the invention, any type of gear transmission elements between the transfer cylinders of the digital printing machine is dispensed with, and the transfer cylinders are connected to one another only via bearer rings which are generally disposed at the ends of the transfer cylinders. One of the transfer cylinders is driven by a motor of the printing machine and entrains the other transfer cylinder via the bearer rings. Due to the multiple torques required at the driven transfer cylinder, the latter is preferably that cylinder which transfers the printing ink onto the substrate.

The invention makes use of the fact that, for a digital printing machine, an absolute synchronization between the transfer cylinders can be dispensed with. A relative synchronization is sufficient, i.e., the phase displacement along the transfer path of the printing ink is at least not greater than the desired print resolution due to the inevitable slippage of the bearer rings. Because a digital printing machine does not employ a printing plate having the structure of the image to be printed, but rather, a complete printing image is produced with each machine cycle, a summing of the slight phase displacements in the course of time has no influence on the print result. This is also true in the case of driving not only the transfer cylinders of one printing unit but rather the transfer cylinders of a plurality of printing units in the manner according to the invention.

A prerequisite for such a relative synchronization, however, is that the preloading between the bearer rings of two transfer cylinders rolling on one another is great enough for an entraining effect to be produced by the friction of the bearer rings and not by the friction between the transfer cylinders. It is possible to manufacture bearer rings having a precisely defined diameter, whereas the enrolling behavior of the transfer cylinder is generally complicated, especially if one of the transfer cylinders is a cylinder having a jacket or an outer cylindrical surface made of elastic material, such as rubber, for example.

During machine operation, a rubber-blanket jams in front of a transfer location at which the blanket is pressed against another transfer cylinder, for example. As a result thereof, the effective circumference of the blanket and its circumferential speed is increased approximately 2 to 3 percent. If, in accordance with the invention, transfer cylinders, one of which is a blanket cylinder, are driven via bearer rings, an appropriate selection of the ratio of the diameters of the bearer rings may, however, ensure that the circumferential speeds of the transfer cylinders are almost identical so that there is as little slip as possible at the transfer location. Furthermore, it should be taken into account that the coefficient of static friction between rubber and steel is approximately five times greater than the coefficient of static friction between steel and steel. If one of the transfer cylinders is a rubber cylinder, a drive according to the invention has to ensure that the contact force between the bearer rings is at least five times as great as the force with which the transfer cylinders are pressed against one another; as a rule it is even much greater in order to provide reserves for changing operating conditions. Moreover, the bearings of the transfer cylinders have to be designed so as to be able to absorb these forces.

On the other hand, the invention dispenses with any gear transmission elements between the individual transfer cylinders so that, compared with conventional printing machines, the drive has a very much simpler construction and, to a great extent, it is maintenance-free. The bearer rings ensure an extremely uniform operation of the transfer cylinders which is not affected by any impact between any type of gear-transmission elements.

The invention is suitable not only for systems having two transfer cylinders, as mentioned hereinabove, but also for a joint or common drive of three or more transfer cylinders. In the case of three in-line connected transfer cylinders, for example, of a printing unit, the middle transfer cylinder may be driven, whereas the other two are entrained therefrom via bearer rings. The transfer cylinders of several printing units disposed in line may also be connected to one another via bearer rings, with only one of the transfer cylinders being driven. Even in the case of an in-line connection of several bearer rings, the slippage at the bearer rings is kept small enough to ensure that the accuracy of the synchronization lies within a tolerable range.

Other features which are considered as characteristic for the invention are set forth in the appended claims.

Although the invention is illustrated and described herein as embodied in a drive for a plurality of transfer cylinders in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
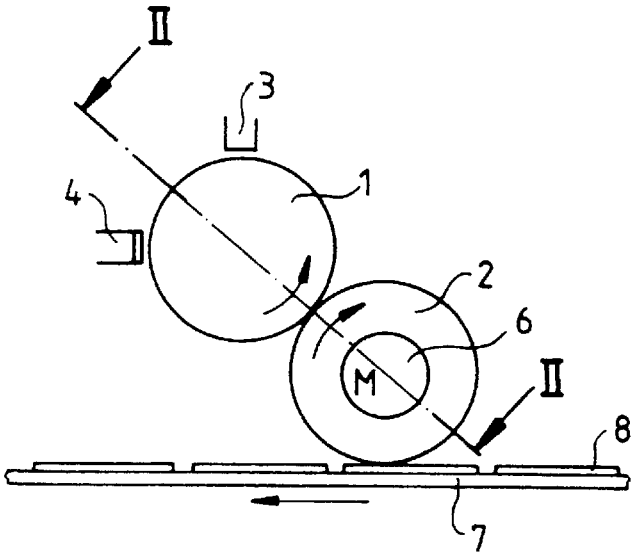
FIG. 1 is a partly diagrammatic side elevational view of a digital printing unit having two transfer cylinders.
Figure 2:
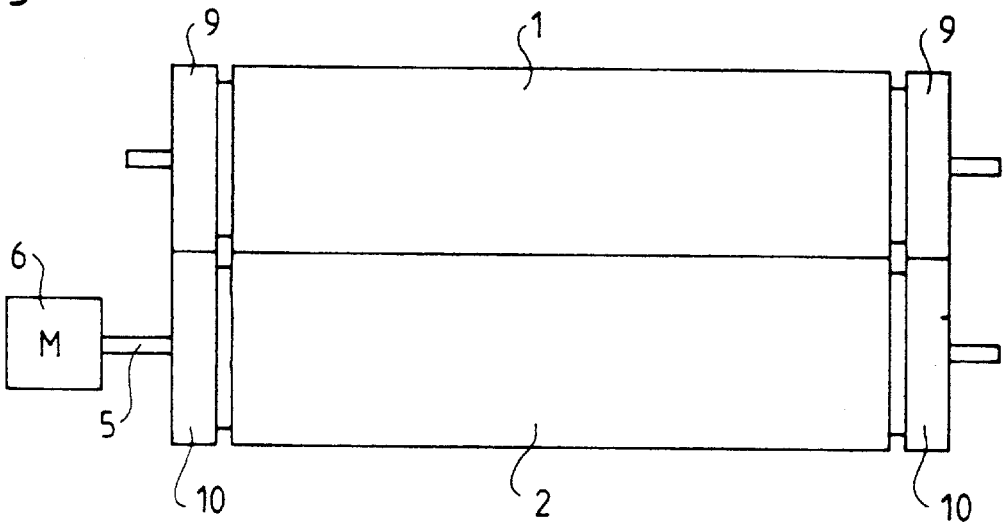
FIG. 2 is a sectional view of FIG. 1 taken along a line II—II in the direction of the arrows.

Referring now to the drawings and, first, particularly, to FIGS. 1 and 2, there is shown therein a digital printing unit having a first transfer cylinder 1 and a second transfer cylinder 2 disposed parallel to one another and contacting one another at respective circumferences or outer cylindrical surfaces thereof. The transfer cylinders 1 and 2 are rotatably mounted on non-illustrated side walls of a printing machine.

An imaging head 3 and an inking unit 4 extending over the entire printing width are provided at the circumference of the first transfer cylinder 1. The second transfer cylinder 2 has a drive shaft 5 connected to a motor 6. As shown in the figures, the motor 6 is disposed on an axis of the second transfer cylinder 2, however, the motor 6 may, of course also be disposed at any other location in the printing machine and may be connected to the drive shaft 5 via power-transmitting elements such as a gear transmission, for example. Furthermore, the second transfer cylinder 2 has an outer cylindrical surface formed of an otherwise non-illustrated elastic material, such as rubber. A conveyor belt 7 shown only fragmentarily and having substrates 8 to be printed deposited thereon extends alongside, adjacent to and engaging the second transfer cylinder 2.

As shown in FIG. 2, two axial bearer rings 9 and 10 formed of case-hardened steel are flanged to respective ends of each transfer cylinder 1, 2, the respective diameter of each of the bearer rings being substantially identical with the diameter of the corresponding transfer cylinder 1, 2. The exact diameter of the respective transfer cylinder 1, 2 and of the respective bearer ring 9, 10 is selected in accordance with the characteristics of the material, so that a defined contact force is maintained between the bearer rings 9 and 10, whereas the transfer cylinders 1 and 2 are pressed against one another with a considerably smaller force, as is explained hereinafter.

The transfer cylinders 1 and 2 represented in FIGS. 1 and 2 have like diameters, however, they may also have different diameters. For example, the transfer cylinder 1 and the bearer rings 9 may have a greater diameter than the transfer cylinder 2 and the bearer rings 10. The exact ratio of the diameters of the bearer rings 9 and 10 is adapted to the specific on-rolling conditions of the transfer cylinders 1 and 2, as are described hereinafter.

When in operation, the conveyor belt 7 conveys the substrates 8 rectilinearly as indicated by the arrow at the bottom of FIG. 1, the substrates 8 being pressed along a rectilinear contact location against the second transfer cylinder. The motor 6 rotates the second transfer cylinder 2 so that the circumferential speed thereof corresponds to the conveying speed of the conveyor belt 7. The second transfer cylinder 2 entrains the first transfer cylinder 1 via the bearer rings 9 and 10 so that the transfer cylinders 1 and 2 roll off on one another in the directions represented by the curved arrows associated therewith in FIG. 1. The imaging head 3 describes a latent image on the first transfer cylinder 1 rotating past it, the latent image being developed in the inking unit 4. The developed printing image is transferred onto the second transfer cylinder 2, from which it is then transferred onto a substrate 8. If necessary, cleaning devices for wiping off ink residues which have not been transferred may be provided at the transfer cylinders 1 and 2.

The bearer rings 9 and 10 effect a very accurate synchronization of the rotary motion of the transfer cylinders 1 and 2. Along the path from the imaging head 3 to the transfer location on the transfer cylinder 2, slippage may occur between the first transfer cylinder and the second transfer cylinder 2, however, the slippage is only a few micrometers or even less, which is readily tolerable.

A prerequisite therefor, however, is that the static friction resistance between the bearer rings 9 and 10 be greater than the static friction resistance between the transfer cylinders 1 and 2. The bearer rings 9 and 10 then roll off on one another in an almost ideal manner, with only a very small slip. The fact that, in practice, an inevitable relative motion occurs between the surfaces of the transfer cylinders 1 and 2 does not have any effect upon the foregoing. The sliding friction resistance for such a relative movement is always smaller than the static friction resistance. Moreover, such relative movements are kept as small as possible from the very beginning by selecting a ratio of the diameters of the bearer rings 9 and 10 which equals the ratio of the circumferences of the transfer cylinders 1 and 2, taking into account the elongation of the rubber jacket or outer cylindrical surface of the second transfer cylinder 2, during operation. This elongation is caused by a deformation of the rubber jacket or outer cylindrical surface of the second transfer cylinder 2 in the vicinity of the transfer location from the first transfer cylinder 1.

The contact forces between the bearer rings 9 and 10 are then estimated, those contact forces being necessary for the second transfer cylinder 2 to entrain the first transfer cylinder 1 largely in synchronism.

Based upon the aforementioned facts, the two transfer cylinders 1 and 2 are pressed against one another with a force $F_2$ required for the transfer process. Between the transfer cylinders 1 and 2, there is a material-dependent static friction coefficient $\mu_z$. The corresponding static friction resistance is $R_z=\mu_z.F_z$. When at a maximum, the static friction resistance $R_z$ has to be overcome by a static friction resistance $R_s$ existing between the bearer rings 9 and 10 which is equal to the product of a contact force $F_s$ existing between the bearer rings 9 and 10 and a corresponding material-dependent static friction coefficient $\mu_s$. Thus, $$R_s=\mu_s.F_s\geqq\mu_z.F_z=R_z$$

If one of the transfer cylinders is made of steel and the other transfer cylinder has an outer jacket or cylindrical surface made of rubber, while the bearer rings are made of steel, $\mu_z$ is approximately five times as great as $\mu_s$.

Thus, the contact force $F_s$ between the bearer rings must be at least five times as great as the contact force $F_z$ between the transfer cylinders, ensuring that the friction between the bearer rings prevails or dominates and that, with the exception of a slight slippage, there is no relative movement therebetween.

In particular, in the case of a transfer cylinder having an outer casing or outer cylindrical surface made of rubber, during operation, the friction resistance may be subjected, however, to temporary fluctuations caused, for example, by nonuniform characteristics of the material or the aforementioned jamming of the material in front of the transfer location. For this reason, a greater contact force $F_s$ between the bearer rings should, in practice, be selected than that resulting from the calculations, i.e. it is ten or even twenty times the force $F_z$ with which the transfer cylinders are pressed against one another.

Cylinder bearings which are able to absorb the forces may be realized with justifiable efforts, in particular, because the ink transfer technologies which are available for digital printing machines often require only relatively small contact forces. Moreover, digital printing machines provide transfer technologies requiring contact forces which are practically of no importance and due to which the invention may thus be realized especially easily.

In the case of an alternative construction which is not illustrated in the drawing, wherein the first transfer cylinder 1 and not the second transfer cylinder 2 is driven by a motor, the torque required at the location at which printing ink is transferred onto the substrate 8 having to be taken into account in addition to the estimated contact forces. The same is true for cases in which not only one transfer cylinder, but also, further transfer cylinders are to be driven via bearer rings. The drives of the transfer cylinders may be connected in line, one after the other, or the bearer rings of one transfer cylinder may drive several other transfer cylinders, if necessary or desirable, through the intermediary of further bearing rings, in order to bridge distances between the transfer cylinders. Such a case is shown in FIG. 3.

Figure 3:
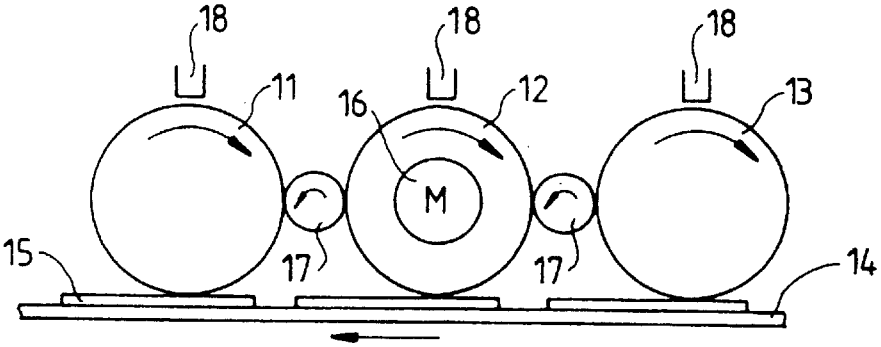
FIG. 3 is a partly diagrammatic side elevational view of a digital printing machine having transfer cylinders of a plurality of printing units, the transfer cylinders being connected to one another via bearer rings.

The printing machine shown in FIG. 3 has three transfer cylinders 11, 12 and 13 which are disposed in tandem above a conveyor belt 14 conveying substrates 15 in the direction of the arrow shown at the bottom of the figure. A motor 16 is connected to the middle transfer cylinder 12, if necessary or desirable, via a non-illustrated gear transmission, and the motor 16 rotates the middle transfer cylinder 12 in the clockwise direction indicated by the curved arrow associated therewith. Like in the embodiment of FIGS. 1 and 2, the transfer cylinders 11, 12 and 13 have lateral bearer rings which are pressed by two additional bearer rings 17 against one another, in a row.

When the motor 16 rotates, the bearer rings of the transfer cylinders 11, 12 and 13, and the additional bearer rings 17 rotate in the directions indicated by the curved arrows in FIG. 3, and the transfer cylinders 11, 12 and 13 rotate accordingly as they pass the imaging heads 18 and inking units such as those of FIG. 1, although not illustrated in FIG. 3, in order to transfer the printing images onto the substrates 15.

The principle illustrated in FIG. 3 may be modified and extended in many ways. It is conceivable, for example, to drive four or five printing units instead of just three. Furthermore, each of the printing units may have not only one transfer cylinder 11, 12 or 13, as shown in FIG. 3, but rather, a respective system having two transfer cylinders, as shown in FIGS. 1 and 2, or even more transfer cylinders. Also with such a chain of transfer cylinders connected to one another via bearer rings, the sum of the slippages between the bearer rings remains tolerable, because the magnitude thereof remains yet within the order of magnitude of micrometers, and thus the total slippage does not perceptibly affect the raster or screen retention of the printing images.

I claim:

1. A device for driving a plurality of transfer cylinders of a digital printing machine, comprising a motor to which one of the plurality of transfer cylinders is connected, and bearer rings rollable on one another under a preloading, the plurality of transfer cylinders being connected to one another via said bearer rings, and said transfer cylinders which are not connected to the motor being substantially exclusively driven through said respective bearer ring.

2. The device according to claim 1, wherein one of said bearer rings is axially fastened to each axial end of each transfer cylinder of said plurality of transfer cylinders; at least, respectively, two of said plurality of transfer cylinders and the bearer rings corresponding thereto being rollable on one another; the preloading ($F_s$) between the bearer rings of two transfer cylinders rolling on one another multiplied by a static friction coefficient ($\mu_s$) of the contacting surfaces of said bearer rings is greater than a contact force ($F_z$) existing between the two transfer cylinders multiplied by a static friction coefficient ($\mu_z$) of the contacting surfaces of the two transfer cylinders.

3. The device according to claim 2, wherein a ratio of the diameters of said bearer rings of the two transfer cylinders rollable on one another is substantially equal to a ratio of the transfer cylinder circumferences effective during operation.

4. The device according to claim 2, wherein one of the two transfer cylinders rolling on one another has a jacket formed of elastic material for transferring printing ink onto a substrate.

5. The device according to claim 4, wherein said motor is connected to the transfer cylinder having the jacket formed of elastic material.

6. The device according to claim 1, including further bearer rings connecting respective transfer cylinders of a plurality of printing units of the printing machine to one another, said motor being connected to one of the transfer cylinders of the plurality of printing units.

* * * * *